US005679051A

United States Patent [19]

Oner et al.

[11] Patent Number: 5,679,051

[45] Date of Patent: Oct. 21, 1997

[54] ROLLING TOY DEVICE

[76] Inventors: Omer Oner; Sabri Akin, both of 25 Chapel St., Brooklyn, N.Y. 11201

[21] Appl. No.: 654,060

[22] Filed: May 28, 1996

[51] Int. Cl.[6] ..... A63H 33/02

[52] U.S. Cl. ..... 446/411; 446/453

[58] Field of Search ..... 446/450–453, 446/411–413

[56] References Cited

U.S. PATENT DOCUMENTS

| | | | |
|---|---|---|---|
| 3,060,636 | 10/1962 | Aquino | 446/453 |
| 3,078,620 | 2/1963 | Frye, Jr. et al. | 446/45 D |
| 3,604,149 | 9/1971 | Salontal . | |
| 3,881,277 | 5/1975 | Delph et al. . | |
| 3,956,851 | 5/1976 | Tapinekis . | |
| 4,453,341 | 6/1984 | Klukos . | |
| 4,897,069 | 1/1990 | Overturf . | |
| 4,911,675 | 3/1990 | Rogers . | |
| 4,917,650 | 4/1990 | Paultre | 446/453 |

FOREIGN PATENT DOCUMENTS

| | | | |
|---|---|---|---|
| 598838 | 5/1960 | Canada | 446/45 D |

*Primary Examiner*—Mickey Yu
*Attorney, Agent, or Firm*—Michael I. Kroll

[57] ABSTRACT

An improved rolling toy device (10) which comprises a circular hoop (12). A component (14) is for loosely engaging the circular hoop (12). A person (15) can hold an end of the loosely engaging component (14) to push and pull the circular hoop (12) along a flat surface (16) and up and down stairs, without the circular hoop (12) getting away from the loosely engaging component (14). A facility (18) on the loosely engaging component (14) is for stopping the circular hoop (12) from rolling along the flat surface (16) and on the stairs.

17 Claims, 2 Drawing Sheets

ROLLING TOY DEVICE

BACKGROUND OF THE INVENTION

1. Field of the Invention

The instant invention relates generally to activity toys and more specifically it relates to an improved rolling toy device.

2. Description of the Prior Art

Numerous activity toys have been provided in prior art. For example, U.S. Pat. Nos. 3,881,277 to Delph et al.; 3,956,851 to Tapinekis and 4,897,069 to Overturf all are illustrative of such prior art. While these units may be suitable for the particular purpose to which they address, they would not be as suitable for the purposes of the present invention as heretofore described.

DELPH, BOB

AMBURGEY, CARL

ROLL-O-WHEEL TOY DEVICE

U.S. Pat. No. 3,881,277

A roll-o-wheel toy device is comprised of a hollow or solid tube formed into a circle to define a hoop. A pushing and guide stick has a handle portion and a head portion. The head portion includes a pusher member extending longitudinally along the stick and has an arcuate groove extending therealong adapted to receive the periphery of the hoop therein for guiding and propelling the hoop. The head portion further includes rod members extending transversely in symmetrical manners on each side of the stick and are adapted for use in the guiding and manipulating of the hoop in any desired path.

TAPINEKIS, WILLIAM

HOOK THE LOOP

U.S. Pat. No. 3,956,851

An activity toy for small children, consisting of a large circular hoop and a push rod for pushing the hoop so it rolls over a ground. The push rod has a loop at one end to form a handle. The other end has a U-shaped hook for fitting against the rim of the hoop. The hoop periphery rollably supports a weight through a frame. The frame further includes a speed indicator for indicating the speed of the hoop.

OVERTURF, STERLIN U.

TOY HOOP AND GUIDE STICK

U.S. Pat. No. 4,897,069

A toy hoop and guide stick allows the hoop to be rolled along and controlled by an individual through use of the guide stick. A rectangular channel member is secured to an end portion of the guide stick and has a width equal to about twice the width of the hoop. This allows a wide variety of maneuvers and tricks to be performed by manipulating the hoop. In a second embodiment, the circular hoop has a hollow circular interior track receiving a plurality of elongated rolling members. The hoop is formed from a transparent material to allow observation of the rolling members. The rolling members include a phosphorescent material.

SUMMARY OF THE INVENTION

A primary object of the present invention is to provide an improved rolling toy device that will overcome the shortcomings of the prior art devices.

Another object is to provide an improved rolling toy device in which a guide control member gripped by a hand of a person can loosely engage with a circular hoop, so that a person can push and pull the hoop to roll along a flat surface, and go up and down stairs, without the hoop getting away from the control member.

An additional object is to provide an improved rolling toy device in which the guide control member gripped by the hand of the person can also be used to stop the hoop from rolling along the flat surface and on the stairs by pressing the control member down, so that braking pads on the guide control member will engage with the hoop to prevent rotation thereof.

A still additional object is to provide an improved rolling toy device that will make a noise when the hoop is rolled along the flat surface and on the stairs.

A further object is to provide an improved rolling toy device that is simple and easy to use.

A still further object is to provide an improved rolling toy device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
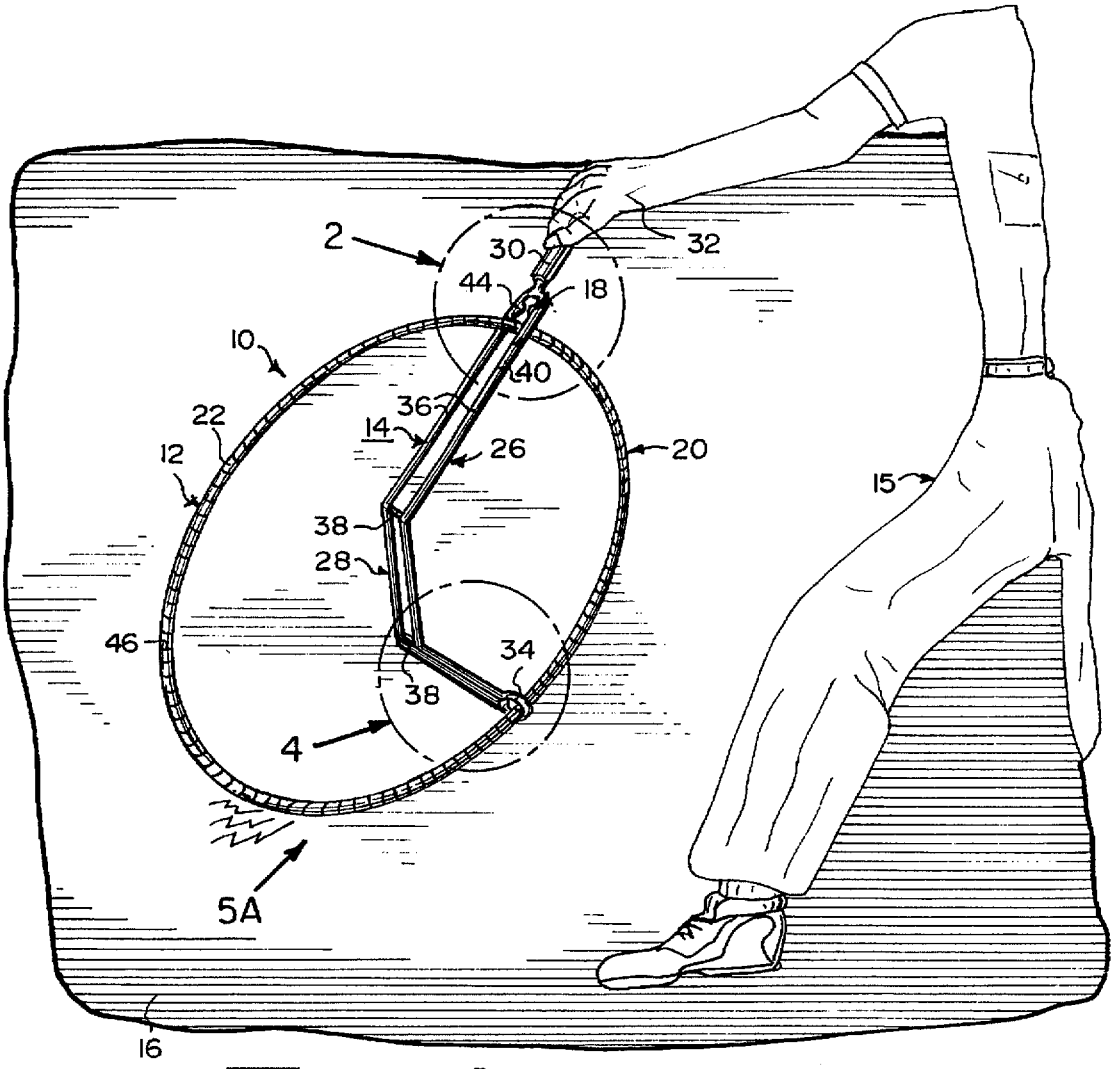
FIG. 1 is a perspective view of the instant invention in use, being rolled upon a flat surface.
Figure 2:
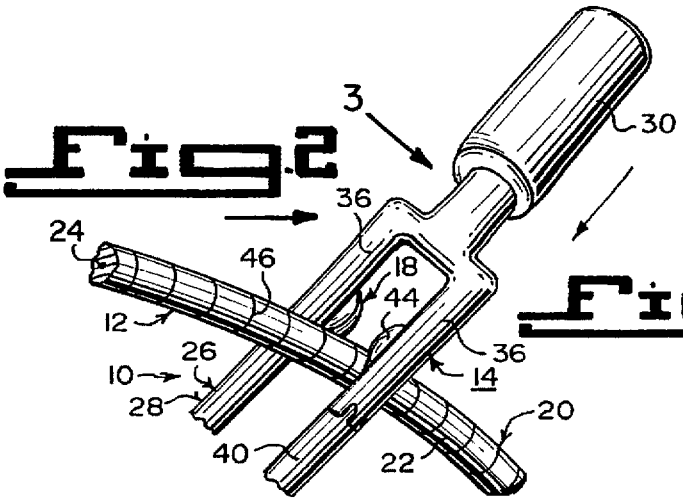
FIG. 2 is an enlarged perspective view of an area indicated by arrow 2 in FIG. 1.
Figure 3:
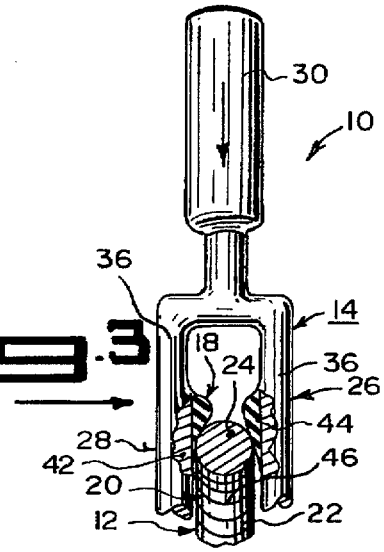
FIG. 3 is a front view taken in the direction of arrow 3 in FIG. 2.
Figure 4:
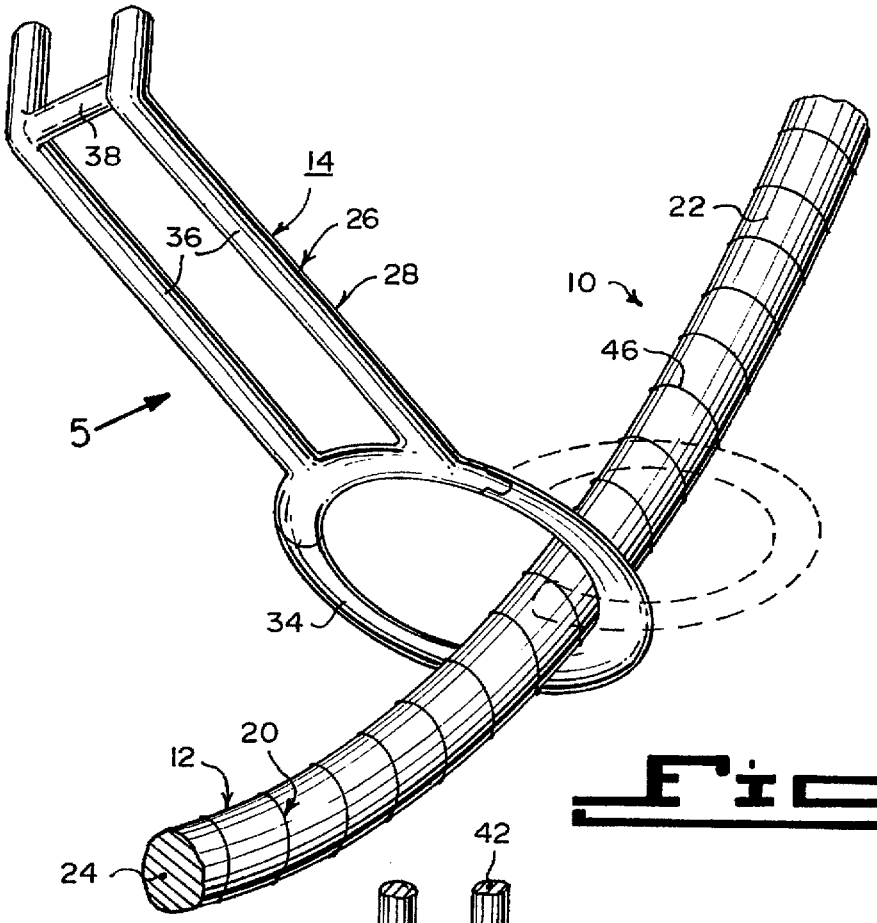
FIG. 4 is an enlarged perspective view of an area indicated by arrow 4 in FIG. 1.

Turning now descriptively to the drawings, in which similar reference characters denote similar elements throughout the several views, FIGS. 1 through 3 illustrate an improved rolling toy device 10, which comprises a circular hoop 12. A component 14 is for loosely engaging the circular hoop 12. A person 15 can hold an end of the loosely engaging component 14, to push and pull the circular hoop 12 along a flat surface 16 and up and down stairs, without the circular hoop 12 getting away from the loosely engaging component 14. A facility 18 on the loosely engaging component 14 is for stopping the circular hoop 12 from rolling along the flat surface 16 and on the stairs.

An assemblage 20 is for making a noise when the circular hoop 12 is rolled along the flat surface 16 and on the stairs. The circular hoop 12 is a continuous ring 22 of a substantially circular cross section.

The continuous ring 22 is fabricated out of a durable material 24. The durable material 24 is metal, such as stainless steel.

The loosely engaging component 14 is a guide control member 26. The guide control member 26 includes an elongated stanchion assembly 28. A handle 30 is on a top end of the stanchion assembly 28. The handle 30 is to be gripped by a hand 32 of the person 15 using the device 10.

An O-shaped clamp member 34 on a bottom end of the stanchion assembly 28 is adapted to loosely clamp about the peripheral cross sectional circumference of the circular hoop 12. The circular hoop 12 can move through the O-shaped clamp member 34, along the flat surface 16 and on the stairs.

The stanchion assembly 28 consists of a pair of elongated generally C-shaped bent shafts 36 that extend downwardly from the handle 30 in a parallel relationship. A pair of corner crossbars 38 extend between the shafts 36.

A latch 40 is on one of the shafts 36 adjacent the handle 30. Upper ends of the shafts 36 can be loosely installed between the circular hoop 12, to allow the circular hoop 12 to move between the shafts 36.

The O-shaped clamp member 34 and the stanchion assembly 28 are integral and fabricated out of a durable material 42. The durable material 42 is metal, such as stainless steel.

The stopping facility 18 consists of a pair of brake pads 44 on the upper ends of the shafts 36. When the person 15 gripping the handle 30 presses downwardly, the brake pads 44 will engage with an outer peripheral edge of the circular hoop 12, to prevent the circular hoop 12 from rolling along.

The noise making assemblage 20, as shown in FIGS. 1 through 4, comprises a plurality of spaced apart annular ribs 46 on the circular hoop 12. When the circular hoop 12 is rolled along the flat surface 16 and on the stairs, the annular ribs 46 by rubbing on the flat surface 16 will produce a sound.

Figure 5:
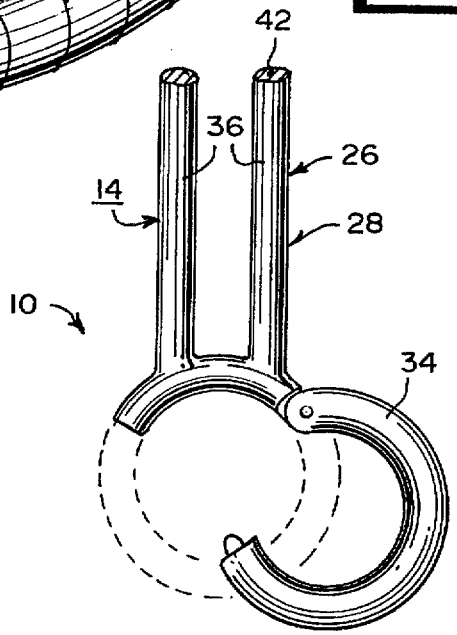
FIG. 5 is a front view taken in the direction of arrow 5 in FIG. 4, with the clamp opened and the circular hoop removed therefrom.
Figure 5A:
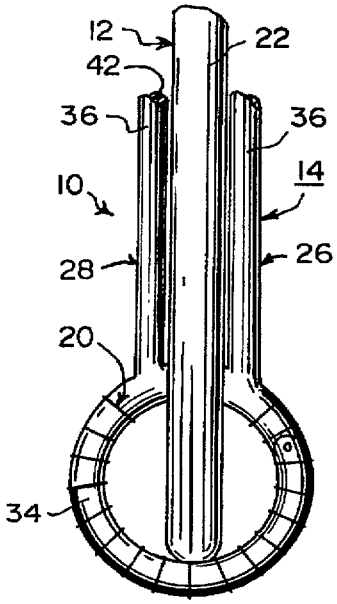
FIG. 5A is an enlarged partial front view taken in the direction of arrow 5A in FIG. 1, showing ribs on the clamp instead of the circular hoop.

The noise making assemblage 20 in FIG. 5A, consists of a plurality of spaced apart annular ribs 48 on the O-shaped clamp member 34. When the circular hoop 12 is rolled along the flat surface 16 and on the stairs, the annular ribs 48 will produce a sound by rubbing on the circular hoop 12.

| LIST OF REFERENCE NUMBERS | |
|---|---|
| 10 | improved rolling toy device |
| 12 | circular hoop of 10 |
| 14 | loosely engaging component of 10 |
| 15 | person |
| 16 | flat surface |
| 18 | stopping facility of 10 |
| 20 | noise making assemblage |
| 22 | continuous ring for 12 |
| 24 | durable material of 22 |
| 26 | guide control member for 14 |
| 28 | elongated stanchion assembly of 26 |
| 30 | handle of 26 |
| 32 | hand of 15 |
| 34 | O-shaped clamp member of 26 |
| 36 | C-shaped bent shaft of 28 |

-continued

| LIST OF REFERENCE NUMBERS | |
|---|---|
| 38 | corner crossbar of 28 |
| 40 | latch on 28 |
| 42 | durable material of 34 and 28 |
| 44 | brake pad of 18 |
| 46 | annular rib on 12 for 20 |
| 48 | annular rib on 34 for 20 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. An improved rolling toy device which comprises:

a) a circular hoop;

b) means for loosely engaging said circular hoop, so that a person can hold an end of said loosely engaging means to push and pull said circular loop along a flat surface and up and down stairs, without said circular hoop getting away from said loosely engaging means, said loosely engaging means being a guide control member having:

i) an elongated stanchion assembly;

ii) a handle on a top end of said stanchion assembly, whereby said handle is to be gripped by a hand of the person using said device; and iii) an O-shaped clamp member on a bottom end of said stanchion assembly adapted to loosely clamp about the peripheral cross sectional circumference of said circular hoop, so that said circular hood can move through said O-shaped clamp member along the flat surface and on the stairs;

c) means on said loosely engaging means for stopping said circular hoop from rolling along the flat surface and on the stairs; and d) means for making a noise when said circular hoop is rolled along the flat surface and on the stairs, wherein said noise making means includes a plurality of spaced apart annular ribs on said O-shaped clamp member, so that when said circular hoop is rolled along the flat surface and on the stairs said annular ribs will produce a sound by rubbing on said circular hoop.

2. An improved rolling toy device which comprises:

a) a circular hoop;

b) means for loosely engaging said circular hoop, so that a person can hold an end of said loosely engaging means to push and pull said circular hoop along a flat surface and up and down stairs, without said circular hoop getting away from said loosely engaging means, said loosely engaging means being a guide control member having:

i) an elongated stanchion assembly including:

1) a handle on a top end of said stanchion assembly, whereby said handle is to be gripped by a hand of the person using said device:

2) a pair of elongated generally C-shaped bent shafts that extend downwardly from said handle in a parallel relationship;

3) a pair of corner crossbars extending between said shafts; and 4) a latch on one of said shafts adjacent said handle, so that upper ends of said shafts can be loosely installed on opposite sides of said circular hoop, to allow said circular hoop to move between said shafts; and ii) an O-shaped clamp member on a bottom end of said stanchion assembly adapted to loosely clamp about the peripheral cross sectional circumference of said circular hoop, so that said circular hoop can move through said O-shaped clamp member along the flat surface and on the stairs;

c) means on said loosely engaging means for stopping said circular hoop from rolling along the flat surface and on the stairs; and d) means for making a noise when said circular hoop is rolled along the flat surface and on the stairs.

3. An improved rolling toy device as recited in claim 1, wherein said circular hoop is a continuous ring of a substantially circular cross section.

4. An improved rolling toy device as recited in claim 3, wherein said continuous ring is fabricated out of a durable material.

5. An improved rolling toy device as recited in claim 4, wherein said durable material is metal.

6. An improved rolling toy device as recited in claim 5, wherein said metal is stainless steel.

7. An improved rolling toy device as recited in claim 6, wherein said O-shaped clamp member and said stanchion assembly are integral and fabricated out of a durable material.

8. An improved rolling toy device as recited in claim 7, wherein said durable material is metal.

9. An improved rolling toy device as recited in claim 8, wherein said metal is stainless steel.

10. An improved rolling toy device as recited in claim 9, wherein said stopping means includes a pair of brake pads on said upper ends of said shafts, so that when the person gripping said handle presses downwardly, said brake pads will engage with an outer peripheral edge of said circular hoop to prevent said circular hoop from rolling along.

11. An improved rolling toy device as recited in claim 10, wherein said noise making means includes a plurality of spaced apart annular ribs on said circular hoop, so that when said circular hoop is rolled along the flat surface and on the stairs, said annular ribs by rubbing on the flat surface will produce a sound.

12. An improved rolling toy device as recited in claim 10, wherein said noise making means includes a plurality of spaced apart annular ribs on said O-shaped clamp member, so that when said circular hoop is rolled along the flat surface and on the stairs said annular ribs will produce a sound by rubbing on said circular hoop.

13. An improved rolling toy device as recited in claim 1, wherein said stopping means includes a pair of brake pads on said upper ends of said shafts, so that when the person gripping said handle presses downwardly, said brake pads will engage with an outer peripheral edge of said circular hoop to prevent said circular hoop from rolling along.

14. An improved rolling toy device as recited in claim 1, wherein said noise making means includes a plurality of spaced apart annular ribs on said circular hoop, so that when said circular hoop is rolled along the flat surface and on the stairs, said annular ribs by rubbing on the flat surface will produce a sound.

15. An improved rolling toy device as recited in claim 1, wherein said O-shaped clamp member and said stanchion assembly are integral and fabricated out of a durable material.

16. An improved rolling toy device as recited in claim 15, wherein said durable material is metal.

17. An improved rolling toy device as recited in claim 16, wherein said metal is stainless steel.

* * * * *